United States Patent [19]

Daniels

[11] 4,109,618

[45] Aug. 29, 1978

[54] ROTARY PISTON POWER CONVERTING DEVICES

[75] Inventor: Leslie E. Daniels, Agincourt, Canada

[73] Assignee: Rotary Power Development Limited, Agincourt, Canada

[21] Appl. No.: 760,689

[22] Filed: Jan. 19, 1977

[51] Int. Cl.[2] ..... F02B 57/00; F01B 13/04

[52] U.S. Cl. ..... 123/43 C; 123/44 C; 91/197; 91/496

[58] Field of Search ..... 123/43 C, 44 C, 44 D, 123/44 E; 91/197, 496

[56] References Cited

U.S. PATENT DOCUMENTS

| | | | |
|---|---|---|---|
| 830,636 | 9/1906 | Bergh | 91/496 |
| 1,034,213 | 7/1912 | Dickinson | 123/44 C |
| 1,338,256 | 4/1920 | Sieverkropp | 123/44 C |
| 2,271,659 | 2/1942 | Moeser | 91/197 |

FOREIGN PATENT DOCUMENTS

| | | | |
|---|---|---|---|
| 1,255,143 | 1/1961 | France | 123/44 E |
| 2,232,222 | 12/1974 | France | 123/43 C |
| 544,410 | 4/1942 | United Kingdom | 91/496 |

*Primary Examiner*—John J. Vrablik
*Attorney, Agent, or Firm*—Sim & McBurney

[57] ABSTRACT

This invention provides a power converting device capable of use as a pump and as a motor. The device includes a rotor shaped like a disc and secured to a shaft about which it rotates. Provided in the rotor are a plurality of piston chambers extending from the outer circumferential surface inwardly at an angle to a radiant from the axis. Each of the chambers opens through both side walls of the rotor, and each contains a piston. Each of the pistons is pivoted on either side to an arcuate drive segment adapted to move around an annular recessed channel within structure which defines a stationary enclosure for the rotor. There are two annular recessed channels, one on either side of the rotor, and the channels are aligned with each other and eccentrically located with respect to the axis of the rotor. With this arrangement, rotation of the rotor within the stationary enclosure is simultaneous with reciprocatory movement of the pistons in their respective piston chambers. Passageway and port means are provided in the apparatus for allowing an interchange between rotary energy and fluid pressure energy.

3 Claims, 6 Drawing Figures

ROTARY PISTON POWER CONVERTING DEVICES

This invention relates generally to power-converting devices such as pumps and motors, and has to do particularly with an apparatus having a basic design which may be adapted for use as a pump or alternatively as a motor by an appropriate selection of ports, passageways and so forth.

The prior art contains a number of pump and motor designs which are based on the provision of a rotor adapted to rotate about a central axis, the rotor having radial piston chambers defined within it along which pistons are adapted to reciprocate, the pistons having pins which extend laterally from the pistons and project beyond the sides of the rotor, such that the pins are entrained within specially shaped camming grooves in a stationary cap member adjacent and against the rotor. Typically, the cap member would be one component of a complete structure which surrounds the rotor and which supports the rotor for rotation. By providing the camming groove in a lobed or eccentric configuration with respect to the centre axis of the rotor, rotation of the rotor necessarily involves reciprocation of the pistons.

Many of the prior art devices in this category, however, have suffered from several drawbacks and disadvantages.

Provided herein is an improved pump/motor apparatus which is designed in such a way as to make full use of the leverage principle particularly when the apparatus is utilized as a motor.

Accordingly, this invention provides an apparatus, comprising:

a substantially disc-like rotor having an outer circumferential surface and two side walls, the rotor being adapted to rotate about a central axis, the rotor defining a plurality of piston chambers each extending from the outer circumferential surface inwardly at an angle to a radiant from said axis, each chamber opening through both side walls, a piston in each chamber, each piston being pivoted to at least one arcuate drive segment located adjacent one side wall of the rotor, structure defining a stationary enclosure for said rotor, said structure also defining, adjacent said one side wall of the rotor, an annular recessed channel in which the arcuate drive segments are received, the recessed channel being eccentric with respect to said central axis of the rotor, whereby rotation of the rotor within said stationary enclosure is simultaneous with reciprocatory movement of the pistons in the respective piston chambers, a fuel inlet manifold in said stationary structure communicating with a first port opening into the piston chambers inwardly of the pistons over a portion of the arc through which a piston is moving outwardly with respect to the rotor;

an exhaust passageway in said stationary structure communicating with a second port opening into the piston chambers outwardly of the pistons at a location advanced in the sense of rotation from the place where a piston is furthest outward, but short of the place where a piston is furthest inward, by-pass passages in said rotor to allow compressed gas in the part of a piston chamber inwardly of a piston to be transferred to the part of the same piston chamber which is outwardly of the piston when the piston is at or near its innermost position, means on the stationary structure for initiating combustion of compressed gas outwardly of a piston when the piston is at or near its outermost position, and further passages connected with further ports communicating with at least one said annular recessed channel where the varying arcuate separations between the segments as the rotor rotates are increasing and decreasing, said further passages being employed to circulate oil for lubrication and cooling.

Two embodiments of this invention are illustrated in the accompanying drawings, in which like numerals denote like parts throughout the several views, and in which.

Figure 1:
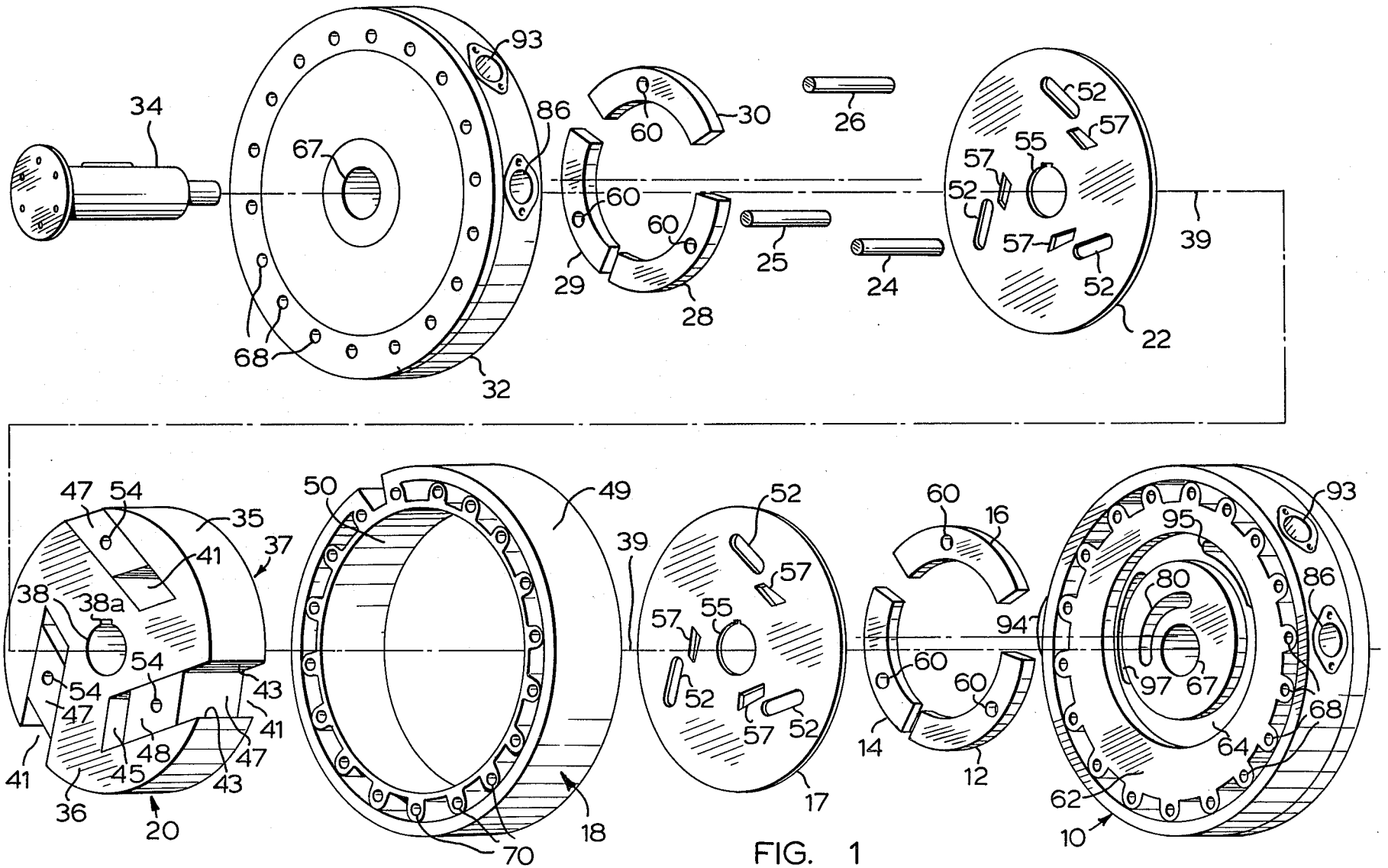
FIG. 1 is an exploded, perspective view of the components of the first embodiment of this invention, which is adapted to function as a motor.

Attention is directed first to FIG. 1 in which the various components of the motor embodiment of this invention are shown in exploded, perspective view. These components include a first end cap 10, three arcuate drive segments 12, 14 and 16, a sealing plate 17, an outer ring housing member 18, a rotor 20, a second sealing plate 22, three wrist pins 24, 25 and 26, three additional arcuate drive segments 28, 29 and 30, a second end cap 32, and a drive shaft 34.

The rotor 20 is substantially disc-like in configuration, and has an outer circumferential surface 35, two side walls 36 and 37 and a central bore 38 with a keyway 38A. The rotor 20 is adapted to rotate about a central axis identified by the line 39.

The rotor 20 defines three piston chambers 41, each of which extends from the outer circumferential surface 35 inwardly at an angle to a radiant from the axis 39 (i.e. a line extending radially away from the axis), and each chamber 41 opens through both side walls 36 and 37, as can be seen in FIG. 1.

In the specific embodiment illustrated in the drawings, each piston chamber 41 is defined by two, opposed planar and parallel side walls 43 which are sloped with respect to a radiant from the axis 39, and a planar, rectangular end wall 45 which is oblique to the plane of the side walls 43.

Contained slidably within each piston chamber 41 is a piston 47 which has two opposed and parallel sides 48 in the shape of identical parallelograms (only one side of each visible in FIG. 1), and four rectangular faces of which two are juxtaposed against the side walls 43 of the respective piston chamber 41.

The outer ring housing member 18 has an outer cylindrical surface 49 and an inner cylindrical surface 50. The rotor 20 is adapted to fit snugly but rotatably within the outer ring housing member 18, such that the inner cylindrical surface 50 can define, at all rotative positions of the rotor 20, an outer end wall which closes the piston chambers 41.

The two sealing plates 17 and 22 are adapted to be applied against the side walls 36 and 37 of the rotor 20 and to be locked or keyed in position so that the sealing plates 17 and 22 rotate with the rotor 20. Each sealing plate 17, 22 is in the shape of a thin disc, and each has three wrist pin slots 52 along which the wrist pins 24, 25 and 26 can slide longitudinally when these are in position in the lateral bores 54 in the pistons 47. Each sealing plate 17, 22 has a central aperture 55 adapted to receive and be keyed onto the drive shaft 34. Finally, each sealing plate 17, 22 has three trapezoidal openings 57 which are adapted to register with the inner corner of each respective piston chamber 41 which lies closest to the central axis 39 of the rotor 20.

Each of the arcuate drive segments 12, 14, 16, 28, 29 and 30 has an intermediate aperture 60 which is sized and adapted to receive an end of one of the wrist pins 24, 25 and 26. As can be seen in FIG. 1, each wrist pin 24, 25 and 26 is longer than the lateral dimension of the respective pistons 47, which means that an end portion of each of the wrist pins will extend beyond the parallelogram walls of the respective piston and can be lodged within the apertures 60 in the arcuate drive segments.

Each of the end caps 10 and 32 has an inside face 62 (seen only on the first end cap 10 in FIG. 1), which defines an annular recessed channel 64 in which the three arcuate drive segments to that side of the rotor 20 are received. The recessed channel is eccentrically located with respect to the central axis 39 of the rotor, such that rotation of the rotor within the outer ring housing member 18 will be simultaneous with reciprocatory movement of the pistons 47 in the respective piston chambers 41. Each end cap 10 and 32 also has a central bore 67 adapted to receive the drive shaft 34, and the end caps are also provided with a plurality of bolt holes 68 adapted to register with similar bolt holes 70 in the outer ring housing member 18, whereby a plurality of bolts can be utilized to secure the end caps 10 and 32 against the outer ring housing member 18, with the remaining structure enclosed within them. Naturally, suitable gaskets would be provided at the mating surfaces between the end caps 10 and 32 and the outer ring housing member 18, so that the chamber defined between them will be substantially gas-tight.

Figure 2:
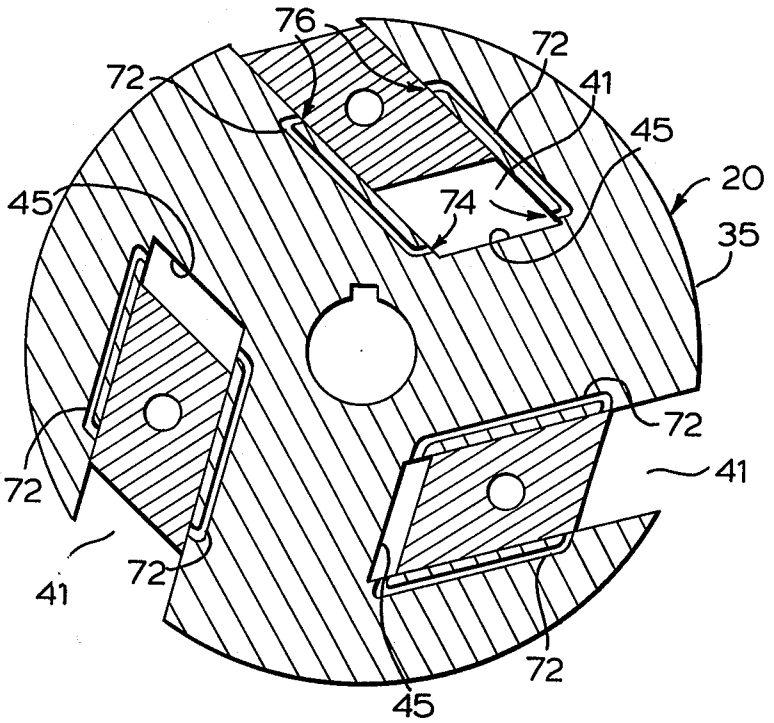
FIG. 2 is a sectional view through the rotor of FIG. 1, taken perpendicular to the axis thereof.

As seen in FIG. 2, the rotor 20 is provided with a number of internal passageways interconnecting spaced portions of each piston chamber 41. Specifically, for each of the piston chambers 41, there are two passageways 72, and each passageway 72 communicates with its respective piston chamber 41 at a first location 74 adjacent the rectangular bottom wall 45 of the respective piston chamber 41, and at a second location 76 approximately two-thirds of the way between the bottom wall 45 and the outer end of the piston chamber, where the same opens through the outer circumferential surface 35 of the rotor 20. The function of the various passageways 72 will become clear subsequently, when the operation of the apparatus as a motor is explained.

Figure 3:
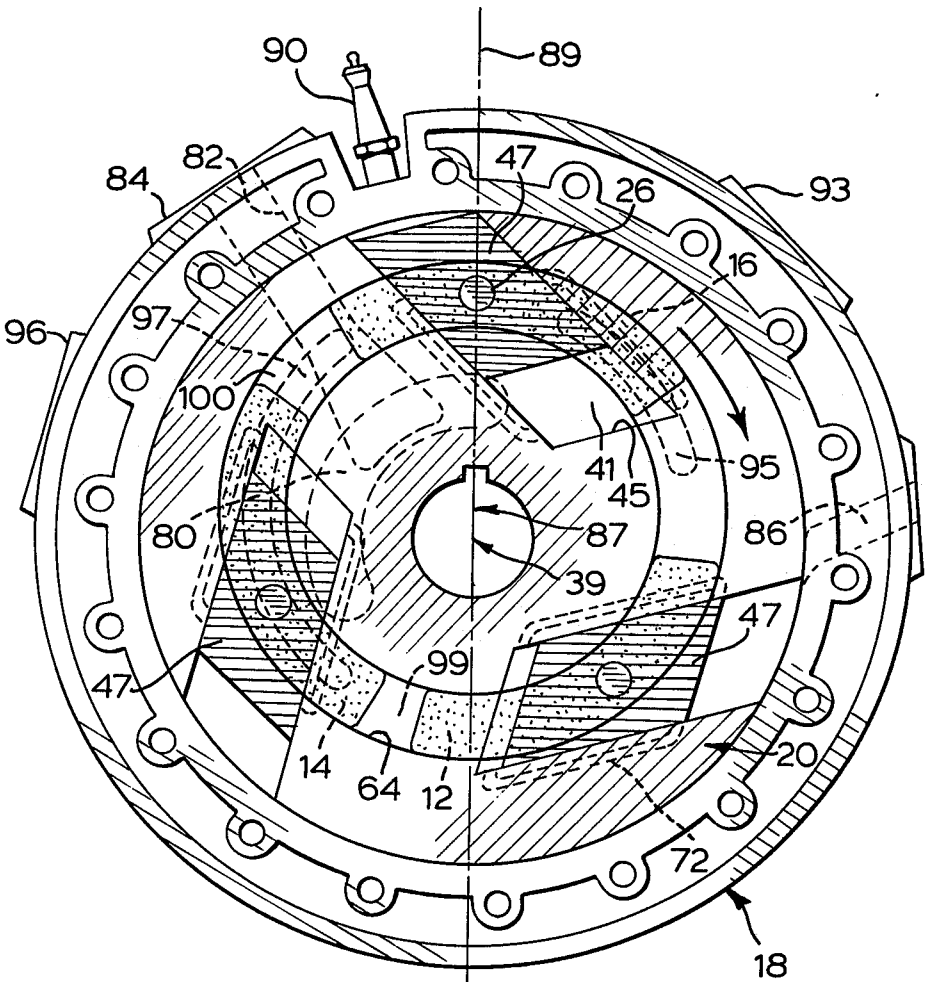
FIG. 3 is a side view of the assembled apparatus of FIG. 1, with the nearer cap member removed to reveal the rotor.

Attention is now directed back to FIG. 1, in which it will be seen that the first end cap 10 includes a fuel inlet port 80, and the latter communicates along a passageway 82 with an inlet manifold 84, the latter two being seen in broken line in FIG. 3.

Also seen in FIG. 3 is an exhaust port 86, which opens through the outer ring housing member 18 at a location shown to the right in FIG. 3. The specific geometric locations of the various ports and other features of the apparatus will be explained subsequently.

Turning now more specifically to FIG. 3, the various portions of the apparatus are shown in a special way in order to facilitate the following description. The three pistons 47 have been hatched as if they were seen in section. The rotor is shown as if in elevational view, and the outer ring housing member 18 is also seen in elevation with the nearer end cap 32 removed. However, the annular recessed channel 64 in the end cap 10, which in FIG. 3 lies behind the rotor 20 and the outer ring housing member 18, is shown in solid lines. This is done to avoid confusion with the various ports within the annular recessed channel 64 (subsequently to be described), and certain other portions illustrated. The bypass passages 72 in FIG. 3 are shown in broken lines.

In FIG. 3, the centre point establishing the position of the axis 39 about which the rotor rotates, and about which the rotor, the outer ring housing member and both end caps are substantially symmetrical, lies directly beneath a point 87 which is located at the centre of curvature of the eccentrically located annular recessed channel 64 located in the end cap 10. In other words, the two points 39 and 87 are aligned vertically, such that a vertical line in FIG. 3 identified by the numeral 89 crosses the annular recessed channel 64 in its upper portion at the point where the annular recessed channel 64 is farthest from the axis 39, and crosses the channel 64 at the lowermost point where the channel is closest to the axis 39. The uppermost point of crossing will be referred to as the top dead centre location, and the bottom location of crossing will be called the bottom dead centre location throughout the remainder of this specification. Also in FIG. 3, the arcuate drive segments 12, 14 and 16 have been stippled in order to avoid confusion with other portions illustrated in that Figure.

The operation of the apparatus in FIG. 3, representing the first embodiment of this invention, will now be explained by tracing the various changes and steps which take place as one of the pistons rotates around through 360° . Taking the piston shown at top dead centre in FIG. 3, it will be seen that the portion of its piston chamber 41 which lies outside of the piston 47 is in communication with the spark plug 90. It is assumed that this small space between the piston 47 and the spark plug 90 contains a highly compressed fuel-air mixture, and that the a spark from the spark plug 90 ignites this mixture. As the rotor 20 rotates around in the clockwise sense as pictured in FIG. 3, the eccentricity of the annular recessed channel 64 in which the arcuate drive segment 16 moves causes the wrist pin 26, as it circles around in the clockwise direction, to move closer to the axis 39. This will be simultaneous with movement of that piston toward the bottom end of its piston chamber 41, so that by the time that piston chamber comes opposite the exhaust port 86, the expanding, burning gases above the piston will have accomplished a considerable amount of work against the piston. When contact is made between the exhaust port 86 and the piston chamber 41, the still highly compressed products of combustion are exhausted out through the exhaust port 86 so that, by the time the piston chamber arrives at the location of the bottom right piston as pictured in FIG. 3, the gas pressure to the outside of the piston is approximately that of the ambience.

Returning again to the top dead centre position for the piston, simultaneously with the existence of a compressed fuel-air mixture to the outside of the piston 47, a newly drawn-in fuel-air mixture is located in the space beneath the piston 47, which is shown at its maximum volume in the top dead centre position. The way in which the fuel-air mixture gets into this chamber will be explained subsequently. As the rotor rotates around in the clockwise direction to carry the piston from the top dead centre position to the position representing 3 o'clock on a clock face, the piston moves downwardly in its piston chamber, and this compresses the fuel-air mixture which is located beneath the piston. By the time the piston gets to the position shown at lower right in FIG. 3, the fuel-air mixture is extremely compressed. The function of the bypass passages 72 will now become apparent. During the time the piston was moving from the top dead centre position to the position at lower right in FIG. 3, the piston itself was blocking the entrances 76 of the passages 72. However, as soon as the piston moves further clockwise past the position shown at bottom right in FIG. 3, these previously blocked passages are opened, and full communication is provided between the two portions of the piston chamber on either side of the piston. Since the gases on the inside of the piston are under high compression, and the remaining products of combustion to the outside of the piston are approximately at atmospheric pressure, there is a sudden rush of fuel-air mixture along the passages 72 as these gases pass into the portion of the piston chamber which lies to the exterior of the piston. This transfer of fuel-air mixture from inside to outside the piston takes place as the piston is passing through the bottom dead centre position as pictured in FIG. 3.

As the piston climbs up the leftward side of the diagram of FIG. 3 during its further clockwise motion, it again begins to move outwardly in its piston chamber and the first thing that happens is that the passages 72 are again blocked by the presence of the piston itself. The newly-transferred fuel-air mixture which now lies to the outside of the piston in the piston chamber is gradually compressed by the outerward movement of the piston 47, since it cannot pass along the passages 72 and return to the portion which lies internally of the piston. However, the movement outwardly of the piston 47 during the stage represented by the piston which is at lower left in FIG. 3, does cause an expansion of the volume of the piston chamber lying to the inside of the piston. During the time of this expansion, that inside portion of the piston chamber is in communication through the openings 57 of the sealing plates 17 with the fuel inlet port 80. This means that a new fuel-air mixture will be drawn along the passageway 82, through the port 80 and into the expanding bottom portion of the piston chamber as the piston moves from approximately the 7 o'clock position to approximately the 12 o'clock position (top dead centre). This is how the new fuel-air mixture is drawn into the bottom end of each piston chamber by the time the piston reaches the top dead centre position.

It will thus be seen how the newly drawn-in but uncompressed fuel-air mixture gets into the bottom portion of the piston chamber in the top dead centre position, and also how a previously drawn-in quantity of fuel-air mixture is compressed and ready for firing on the outside of the piston 47 when the same reaches the top dead centre position.

By sloping the piston chambers 41, the pressure exerted by the gradually compressing fuel-air mixture in the bottom end of each piston chamber, as the same rotates around from the top dead centre position to the bottom dead centre position, exerts a force over the area of the bottom wall 45 of the piston chamber, which constitutes a force substantially at right angles to a line between the bottom wall 45 and the axis 39 of the drive shaft, thereby to give rise to a moment arm or a torque which is communicated to the rotor 20.

The relative rotational movements of the arcuate drive segments within the annular recessed channels 64 of the end caps can be utilized to pump oil for lubricating the various moving parts of this rotary engine. It will be noted that, in the particular configuration of FIG. 3, the arcuate gaps between each pair of adjacent arcuate segments is different. In effect, as the rotor 20 rotates around in a clockwise direction, the specific spacing between each two adjacent arcuate drive segments changes as the arcuate segments move closer to and further from each other. An oil outlet port 93 is shown at upper right in FIG. 3, and this communicates through a passageway (not shown) with an opening 95 in the base of the annular recessed channel 64 of the end cap 10. An identical passageway structure is provided in the other end cap 32, and indeed all of the various ports which have been discussed in connection with FIG. 3 can be duplicated in the other end cap.

Likewise, an oil inlet port 96 is provided in the end cap 10 to the left in FIG. 3, and this communicates along a passageway (not shown) with an elongated further opening 97 also in the base of the annular recessed channel 64.

In FIG. 3, the gap between any two arcuate drive segments is the least when the gap itself is located at the bottom dead centre position. The gap identified by the numeral 99 in FIG. 3 is close to that position, and is very close to its least volume. As it moves further clockwise along the annular recessed channel 64, it will come into contact with the counter-clockwise end of the opening 97, and oil will gradually be drawn into this gap. By the time the gap gets to the 10 o'clock position as identified by the numeral 100 in FIG. 3, it is approaching its maximum volume which is achieved at roughly the uppermost location at the top dead centre point. Then, as the gap continues to move around clockwise from the top dead centre position, its extent gradually decreases, and during this time it comes adjacent the opening 95 so that the decreasing volume of the gap can expel oil contained therein outwardly through the oil outlet port 93.

Figure 4:
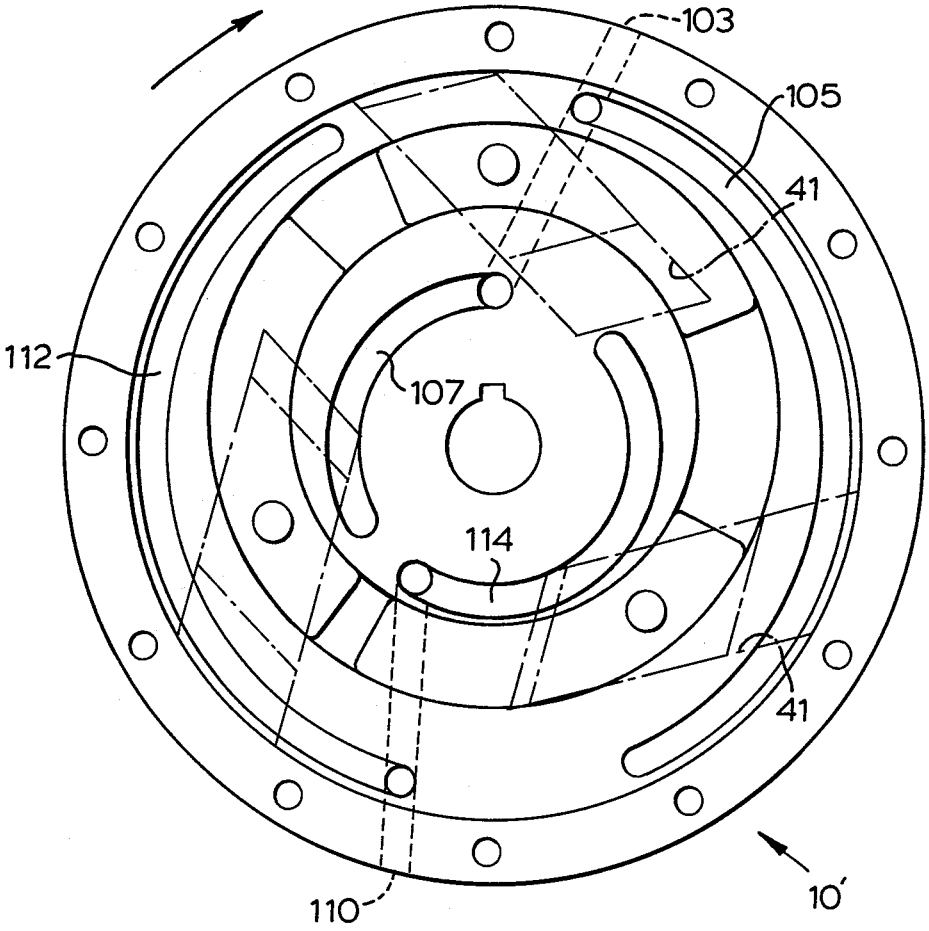
FIG. 4 is a view from inside of one of the cap portions for the second embodiment of this invention, in which the apparatus is adapted to function as a pump.

Attention is now directed to FIGS. 4 and 5, which shown the pump embodiment (the second embodiment) of this invention.

The pump embodiment is much simplified over that which has been described in connection with the previous figures.

Figure 5B:
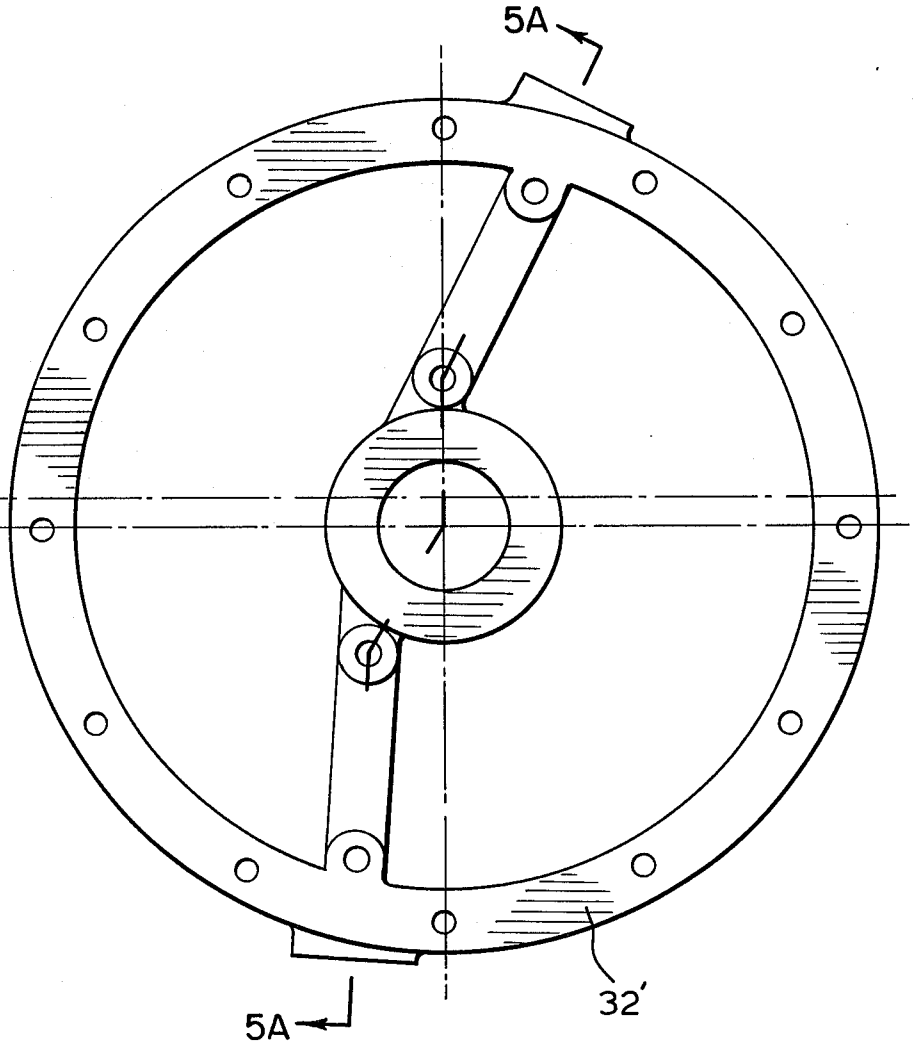
FIGS. 5A and 5B are an axial sectional view and an elevational view of the second embodiment of this invention.
Figure 5A:
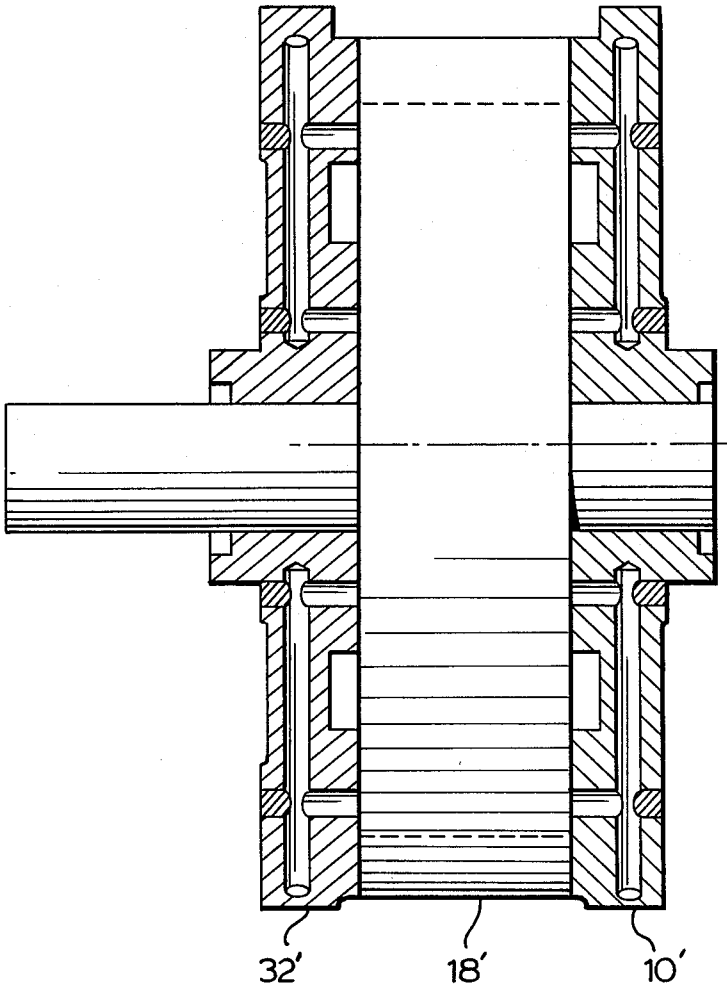

The apparatus shown in FIGS. 4, 5A and 5B includes a suction passageway 103 which is located in the first end cap 10', and which communicates with (a) a first arcuate port 105 which is adapted to open into the piston chambers 41 outwardly of the pistons over a major portion of the arc through which a piston is moving inwardly with respect to the rotor, which means over a major portion of the arc represented as 180° following clockwise from the top dead centre position, and (b) a second arcuate port 107 adapted to open into the piston chambers inwardly of the pistons over a major portion of the arc through which a piston is moving outwardly with respect to the rotor, which means over a major portion of the 180° stretching counter-clockwise from the top dead centre position.

A delivery passageway 110 is provided also in the end cap 10', which communicates with (a) a third arcuate port 112 which is adapted to open into the piston chambers outwardly of the pistons over a major portion of the arc through which a piston is moving outwardly with respect to the rotor (to the left in FIG. 4), and (b) a fourth arcuate port 114 which is adapted to open into the piston chambers inwardly of the pistons over a major portion of the arc through which a piston is moving inwardly with respect to the rotor (to the right in FIG. 4).

As seen in FIG. 5A, the other end cap 32' can be similarly provided with ports and passageways.

It will thus be appreciated that, as a given piston moves around clockwise from the top dead centre position in FIG. 4, the gradually expanding upper or outer portion of its piston chamber will come into communication with the arcuate port 105, and fluid will be drawn through the suction passageway 103. This communication with the arcuate port 105 will cease when the piston chamber reaches the bottom dead centre position. Thereafter, the piston will gradually begin to move outwardly again in its piston chamber, gradually shrinking the volume of the piston chamber which lies outwardly of the piston. During this portion of its movement, the outward portion of the piston chamber is in communication with the arcuate port 112, which communicates with the delivery passageway 110.

Regarding the portion of each piston chamber which lies inwardly of the piston, as the piston chamber begins to move in the clockwise direction from the top dead centre position, its lower portion comes into communication with the arcuate port 114, which communicates with the delivery passageway 110. Fluid in the bottom portion of the piston chamber is thus expelled through the delivery passageway 110 by virtue of the fact that the piston is moving downwardly in the piston chamber and shrinking the volume of the piston chamber beneath it. Similarly, during the portion of its movement when the bottom portion of the piston chamber is expanding its volume, the same is in communication with the arcuate port 107, which in turn communicates with the suction passageway 103, thereby drawing fluid into the bottom portion of the piston chamber.

In the preferred embodiments illustrated, each arcuate drive segment covers about 95° of arc, with the intermediate aperture 60 being spaced about 37° from one end. It will be appreciated that the arcuate drive segments are elongated to ensure that at no point in the revolution of the rotor does a piston chamber communicate with an open part of recessed channel 64. If such should occur, any compression at that time existing in the piston chamber would be lost. The elongated drive segments occupy the full cross-section of the channel 64 and prevent such decompression for occurring.

I claim:

1. An apparatus, comprising:

a substantially disc-like rotor having an outer circumferential surface and two side walls, the rotor being adapted to rotate about a central axis, the rotor defining a plurality of piston chambers each extending from the outer circumferential surface inwardly at an angle to a radiant from said axis, each chamber opening through both side walls, a piston in each chamber, each piston being pivoted to at least one arcuate drive segment located adjacent one side wall of the rotor, structure defining a stationary enclosure for said rotor, said structure also defining, adjacent said one side wall of the rotor, an annular recessed channel in which the arcuate drive segments are received, the recessed channel being eccentric with respect to said central axis of the rotor, whereby rotation of the rotor within said stationary enclosure is simultaneous with reciprocatory movement of the pistons in the respective piston chambers, a fuel inlet manifold in said stationary structure communicating with a first port opening into the piston chambers inwardly of the pistons over a portion of the arc through which a piston is moving outwardly with respect to the rotor;

an exhaust passageway in said stationary structure communicating with a second port opening into the piston chambers outwardly of the pistons at a location advanced in the sense of rotation from the place where a piston is furthest outward, but short of the place where a piston is furthest inward, by-pass passages in said rotor to allow compressed gas in the part of a piston chamber inwardly of a piston to be transferred to the part of the same piston chamber which is outwardly of the piston when the piston is at or near its innermost position, means on the stationary structure for initiating combustion of compressed gas outwardly of a piston when the piston is at or near its outermost position, and further passages connected with further ports communicating with at least one said annular recessed channel where the varying arcuate separations between the segments as the rotor rotates are increasing and decreasing, said further passages being employed to circulate oil for lubrication and cooling.

2. The apparatus claimed in claim 1, in which each piston is pivoted to two aligned arcuate drive segments, the stationary enclosure defining, adjacent the other side wall of the rotor, a further annular recessed channel aligned with that first described, the arcuate drive segments for each piston being received in the two channels.

3. The apparatus claimed in claim 1, in which, if a "top dead center line" be defined as that extending radially from said axis to the pivot of a piston when the latter is in its furthest outward position, and if the direction of rotation of the rotor be regarded from the side where it appears to be in the clockwise sense:

the said first port covers substantially 120° counter-clockwise from said top dead centerline, the second port is located substantially 90° clockwise from said top dead center line, adjacent the outer circumferential surface of the rotor, the means for initiating combustion is constituted by at least one spark plug located approximately 15° counter-clockwise from said top dead center line, and said by-pass passages are activated when a piston is located substantially 180° from said top dead center line.

* * * * *